US010639783B1

(12) United States Patent
Guirlinger

(10) Patent No.: US 10,639,783 B1
(45) Date of Patent: May 5, 2020

(54) TOOL HOLDER

(71) Applicant: Edward G. Guirlinger, New Albany, OH (US)

(72) Inventor: Edward G. Guirlinger, New Albany, OH (US)

( * ) Notice: Subject to any disclaimer, the term of this patent is extended or adjusted under 35 U.S.C. 154(b) by 60 days.

(21) Appl. No.: 16/041,802

(22) Filed: Jul. 22, 2018

(51) Int. Cl.
*B25H 3/00* (2006.01)
*E03C 1/302* (2006.01)

(52) U.S. Cl.
CPC ..... *B25H 3/006* (2013.01); *E03C 1/302* (2013.01)

(58) Field of Classification Search
USPC ..... 206/349; 248/37.3; 211/69
See application file for complete search history.

(56) References Cited

U.S. PATENT DOCUMENTS 5,363,957 A * 11/1994 Reichner ..... A47F 5/0006 15/220.4
6,371,312 B1 * 4/2002 Tsuchida ..... A47G 21/14 211/70.7
7,032,748 B2 * 4/2006 Conklin ..... B25C 3/002 206/338
8,079,487 B2 * 12/2011 Roesler ..... B25H 3/023 206/349
2005/0098459 A1 * 5/2005 Gorman ..... B25H 3/06 206/349
2013/0062234 A1 * 3/2013 Roesler ..... B65D 21/086 206/349
2014/0069831 A1 * 3/2014 Miyawaki ..... B26B 29/025 206/349
2015/0068936 A1 * 3/2015 Huang ..... A45F 5/021 206/349
2015/0174757 A1 * 6/2015 Wang ..... B25H 3/003 206/349

* cited by examiner

*Primary Examiner* — Jacob K Ackun
(74) *Attorney, Agent, or Firm* — Robert R. Lech; Lech Law, LLC

(57) ABSTRACT

A tool holder comprises an insertion element, a collar and a frame. The insertion element is sized to fit within an opening of a chamber. The insertion element comprises at least one retention element, and each retention element is configured to apply pressure to a wall of the chamber thereby maintaining the disposition of the tool holder relative to the chamber. The collar is attached to the insertion element, and the collar is sized to prevent the tool holder from being completely inserted within the chamber. The frame defines an aperture sized to allow at least a portion of an elongated tool to drop through the aperture, yet further sized to prevent at least a portion of the elongated too to drop through the aperture, thereby suspending the elongated tool.

22 Claims, 7 Drawing Sheets

SECTION A-A

SECTION B-B

TOOL HOLDER

TECHNICAL FIELD

The present application relates generally to devices for holding tools, and more particularly to a holder for elongated tools such as drain snakes and the like.

STATEMENT REGARDING FEDERALLY SPONSORED RESEARCH

No government monies were used in the development of the subject matter of this application.

BACKGROUND

Devices for holding tools are well known, such as hooks, brackets, and pockets. There is a need for a tool holding device that enables an elongated tool to be removably held and retained within a tube, such as a portion of a tool cart, so as to protect the elongated tool.

SUMMARY

According to a first aspect of the present application, an example tool holder is disclosed. The example tool holder device comprises an insertion element, a collar and a frame. The insertion element is sized to fit within an opening of a chamber. The insertion element comprises at least one retention element, and each retention element is configured to apply outward pressure when pressure is applied toward the axial center of the tool holder.

The collar is attached to the insertion element. The collar is sized to prevent the tool holder from being completely inserted within the chamber. The frame defines an aperture that is sized to allow at least a portion of an elongated tool to drop through the aperture and into the chamber. The aperture is further sized to prevent at least a portion of the elongated tool from dropping through the aperture and into the chamber, thereby suspending the elongated tool.

According to a second aspect of the present application, a an example tool holder assembly is disclosed. The example tool holder assembly comprises: a tube, and a tool holder. The tool holder comprises: an insertion element, a collar and a frame. The tube defines a square opening at a first end. The insertion element of the tool holder comprises at least one retention element. Each retention element is configured to apply outward pressure when pressure is applied toward the axial center of the tool holder.

The collar of the tool holder is attached to the insertion element. The collar and frame define an aperture.

An object of the present application is to describe a tool holder that holds an elongated tool. A further object of the present application is to describe a tool holder that protects and secures the elongated tool by partially enclosing the elongated tool within a chamber. These and other objects, features, and/or advantages may accrue from various aspects of embodiments of the present application, as described in more detail below.

BRIEF DESCRIPTION OF THE DRAWINGS

The accompanying figures, which are incorporated in and constitute a part of the specification, illustrate various example systems, devices methods, and so on, and are used merely to illustrate various example embodiments. Like reference numerals refer to identical or similar components or steps. It should be noted that the various components depicted in the figures may not be drawn to scale, and that the various assemblies and designs depicted in the figures are presented for purposes of illustration only, and should not be considered in any way as limiting.

DRAWING REFERENCE NUMERALS

Figure 1:
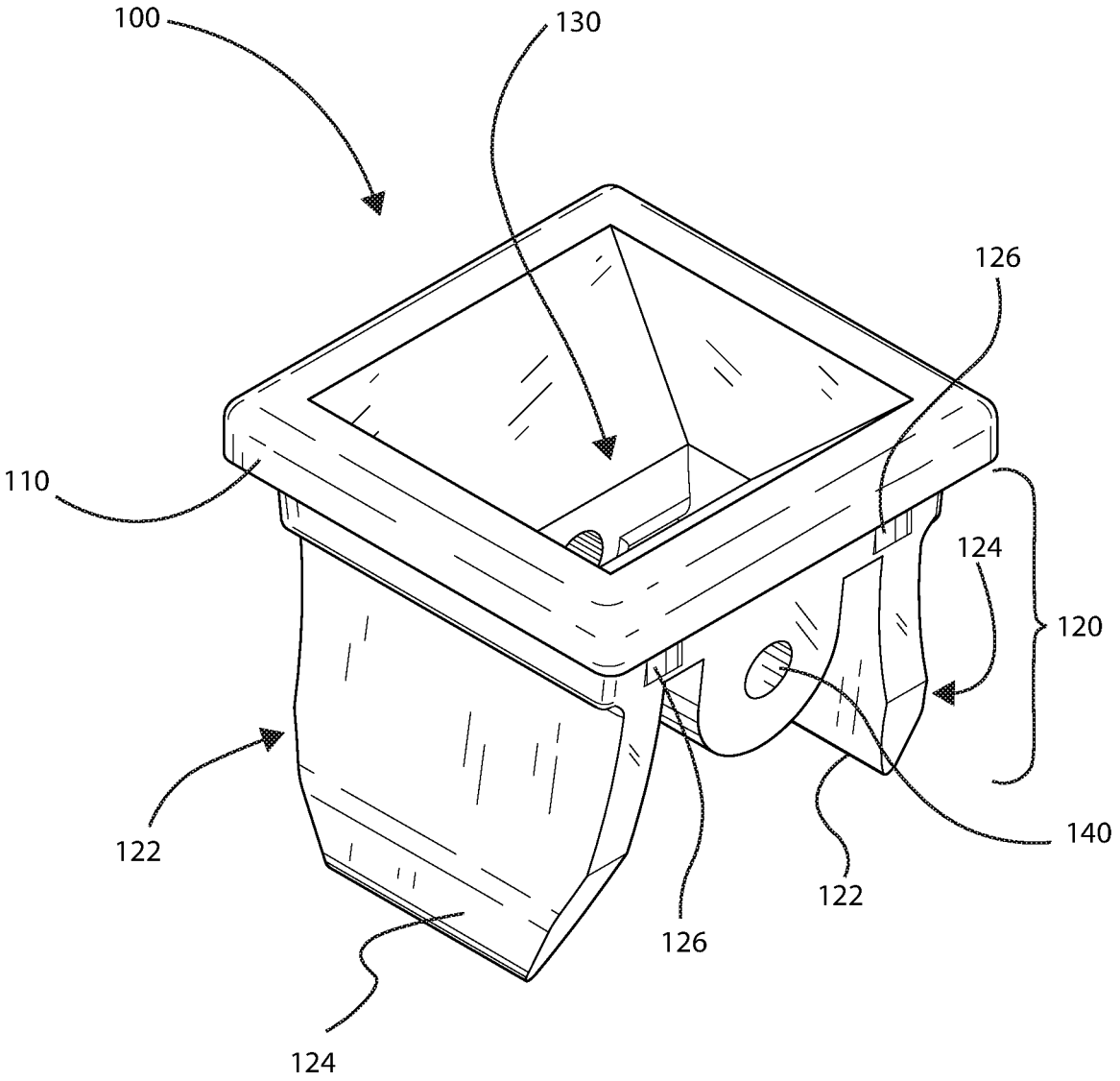
FIG. 1 is a top perspective view of an example tool holder in accordance with this application.

The following reference characters identify the associated elements depicted in the drawings describing the present invention:

| | | | |
|---|---|---|---|
| 100 | Example Tool Holder | 126 | Size Compensator |
| 110 | Collar | 130 | Interior Frame |
| 120 | Insertion Element | 135 | Insertion Wall |
| 122 | Retention Element | 137 | Extraction Wall |
| 124 | Pressure Surface | 140 | Fastener Receiving Structure |
| 150 | Aperture | 1020 | Fastener |
| 1010 | Tube | 1030 | Elongated Tool |

DETAILED DESCRIPTION

Particular embodiments of an example tool holder will now be described in greater detail with reference to the figures. Like reference numerals apply to similar parts throughout the several views.

FIG. 1 is a top perspective view of an example tool holder 100 in accordance with this application. Example tool holder 100 comprises a collar 110. Collar 110 is attached to or integrated with an insertion element 120. Insertion element 120 is sized to fit within an opening of a chamber, such as chamber 1010 (best shown in FIG. 10). In the example embodiment, tool holder 100 is configured to cooperate with a tube having a square opening, but in alternate embodiments, the tool holder 100 may be configured to work with chambers having differently shaped openings, such as round, rectangular, triangular, or any other shaped opening.

Collar 110 is sized to prevent the tool holder from being completely inserted within the chamber. In the illustrated embodiment, collar 110 is configured to sit atop the opening to the tube or chamber, but in an alternate embodiment, a tool holder may have a collar that partially encloses the inner and outer walls of the tube or chamber at the opening.

Insertion element 120 comprises at least one retention element 122. Each retention element 122 is configured to apply pressure to a wall of the chamber thereby maintaining the disposition of the tool holder relative to the chamber. In the illustrated embodiment, each retention element 122 is shaped like a fin. Each retention element 122 applies pressure to a chamber wall along a pressure surface 124. In a first alternate embodiment, the insertion element may include a retention element that mates with a recessed portion of a wall of the chamber. In a second alternate embodiment, the insertion element may include a retention element that cooperates with a raised portion of a wall of the chamber.

Figure 2:
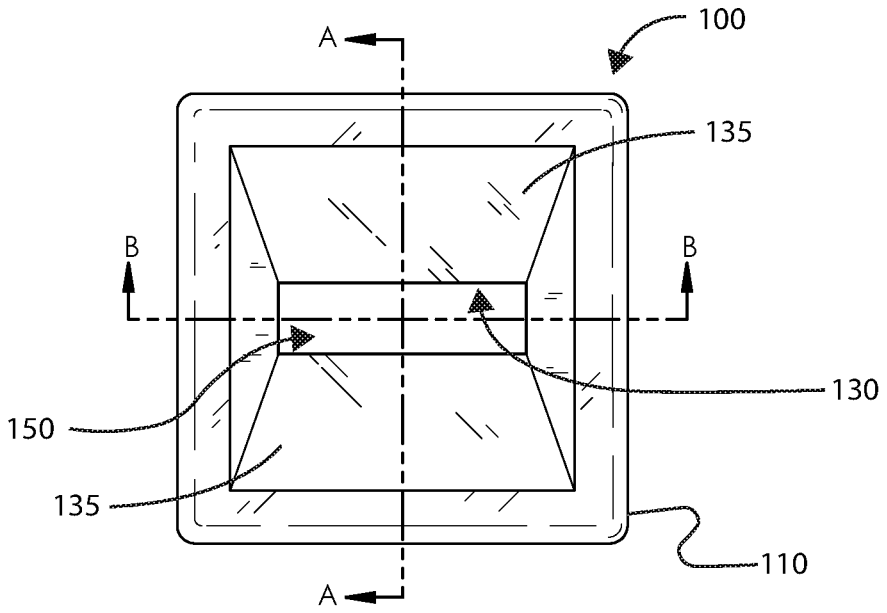
FIG. 2 is a top plan view of the example tool holder of FIG. 1.

Referring now to FIG. 2, tool holder 100 further comprises an interior frame 130 that defines an aperture 150 through which at least a portion of an elongated tool may pass. The aperture 150 is sized to allow at least a portion of an elongated tool to drop through the aperture, and the aperture is further sized to prevent at least a portion of the elongated tool from dropping through the aperture, thereby suspending the elongated tool.

Figure 3:
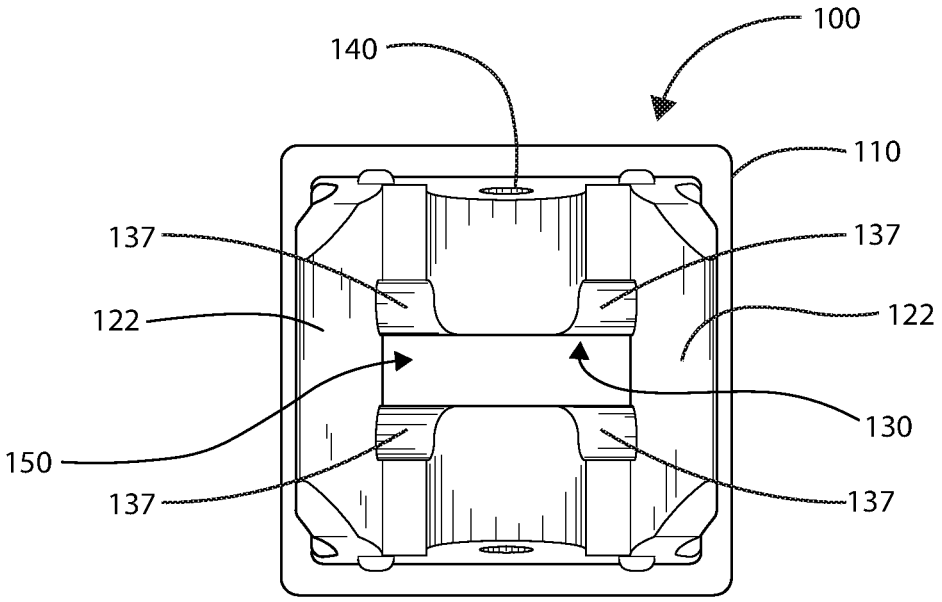
FIG. 3 is a bottom view of the example tool holder of FIG. 1.

As illustrated at reference number 130, the upper entryway to the aperture 150 is defined by at least one insertion wall 135. Each insertion wall 135 is disposed such that, when the elongated tool is suspended from the tool holder 100, the elongated tool and the insertion wall 135 form an acute angle. Referring to FIG. 3, as illustrated at reference numbers 137, the internal path leading into aperture 130 is defined by at least one rounded extraction wall 137. The acute angles of the insertion walls 135 and the rounded construction of the extraction walls 137 ensure that any barbs along the elongated tool will not catch on the tool holder when the tool is being inserted and/or extracted.

Figure 4:
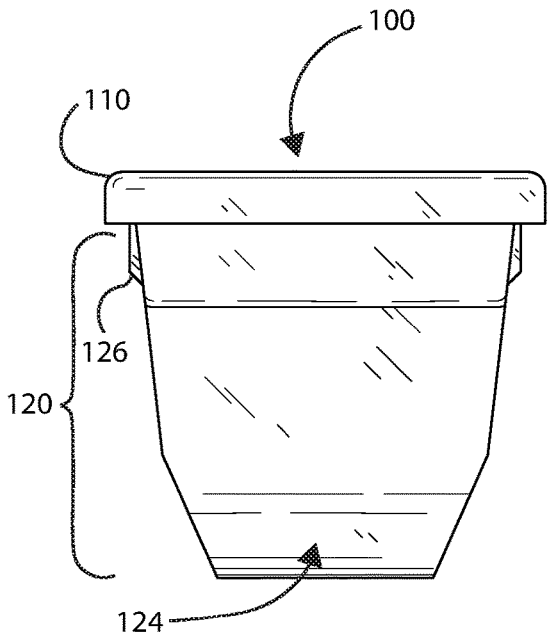
FIG. 4 is a left side view of the example tool holder of FIG. 1.
Figure 5:
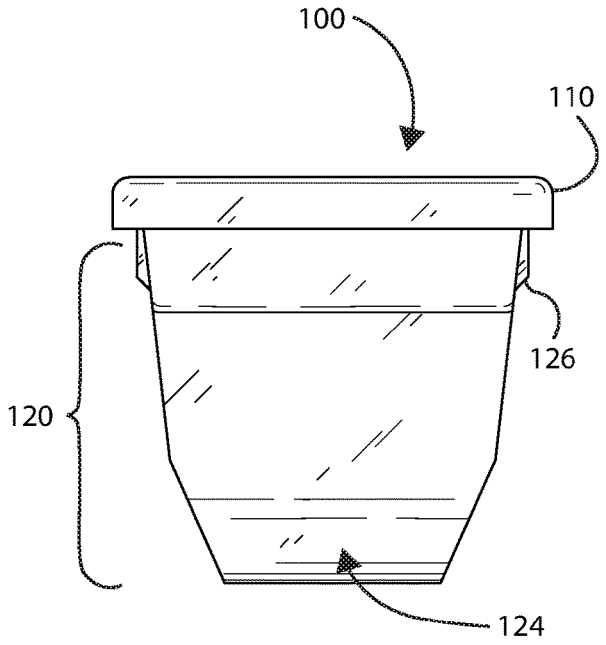
FIG. 5 is a right side view of the example tool holder of FIG. 1.
Figure 6:
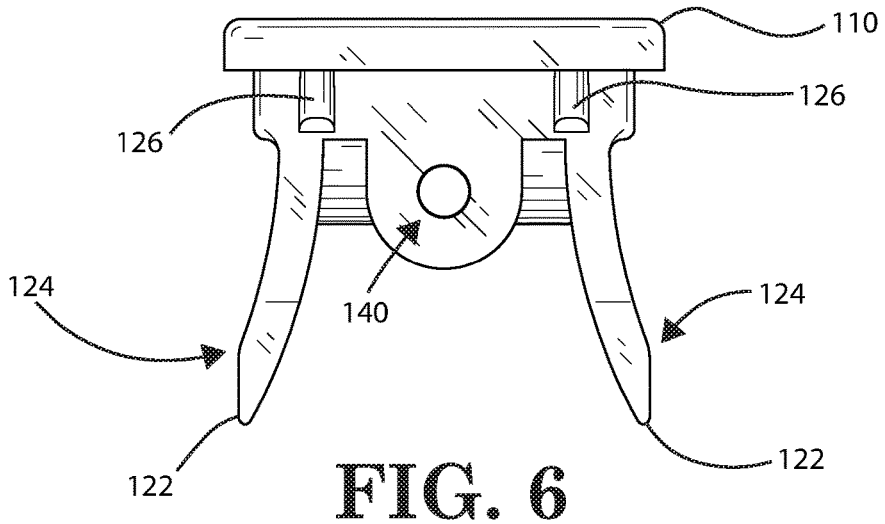
FIG. 6 is a front side view of the example tool holder of FIG. 1.

Referring now to FIGS. 4-6, example tool holder 100 is shown from the sides and front. In these views, size compensator 126 is prominently depicted. Each size compensator 126 is a plastic protrusion that permits the tool holder 100 to be installed in chambers of various sizes. When tool holder 100 is inserted into a larger chamber, size compensators 126 act as spacers to provide a snug fit. When tool holder 100 is inserted into a smaller chamber, the walls of the chamber scrapes off as much of the size compensators 126 as necessary to provide a snug fit.

Figure 7:
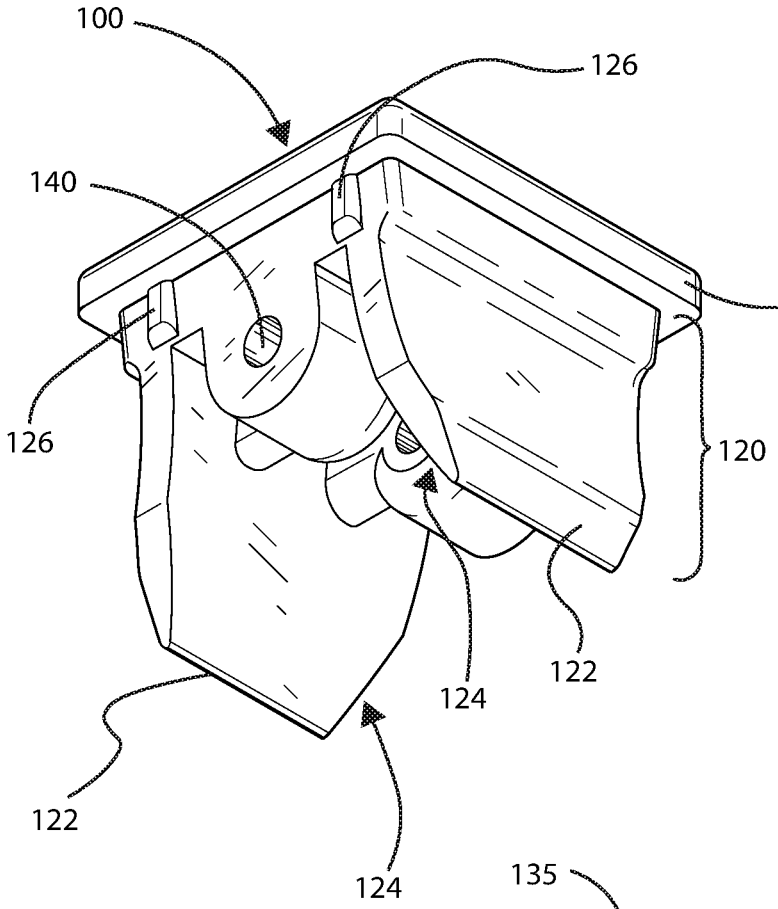
FIG. 7 is a bottom perspective view of the example tool holder of FIG. 1.
Figure 8:
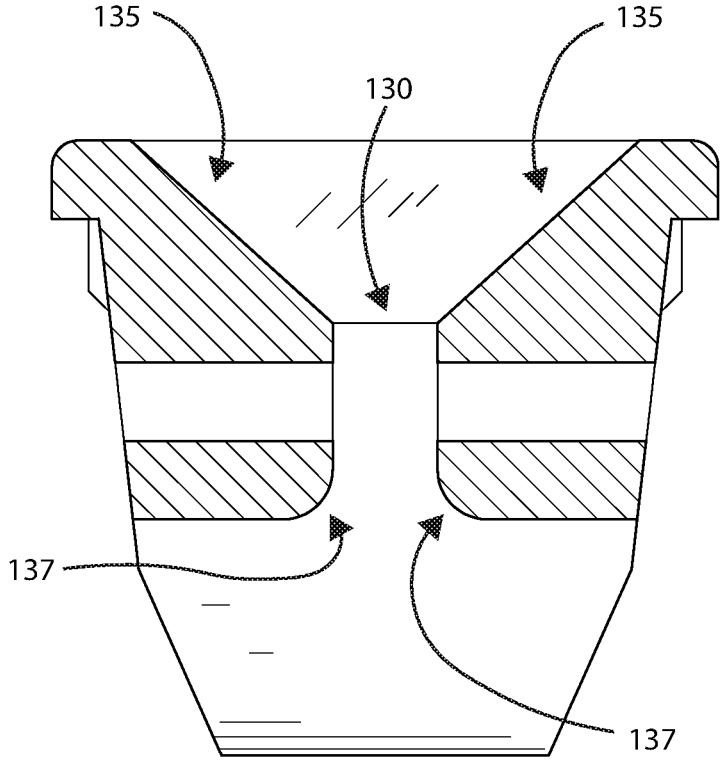
FIG. 8 is a sectional view of the example tool holder according to section A-A of FIG. 2.
Figure 9:
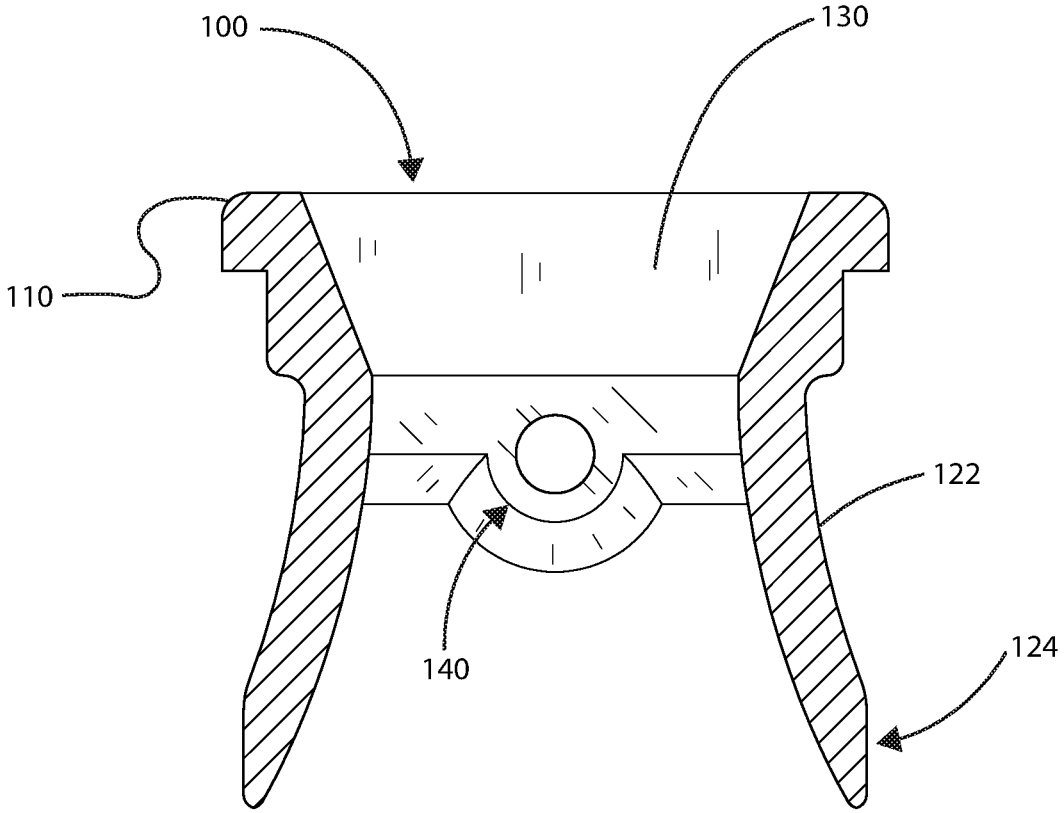
FIG. 9 is a sectional view of the example tool holder according to section B-B of FIG. 2.
Figure 10:
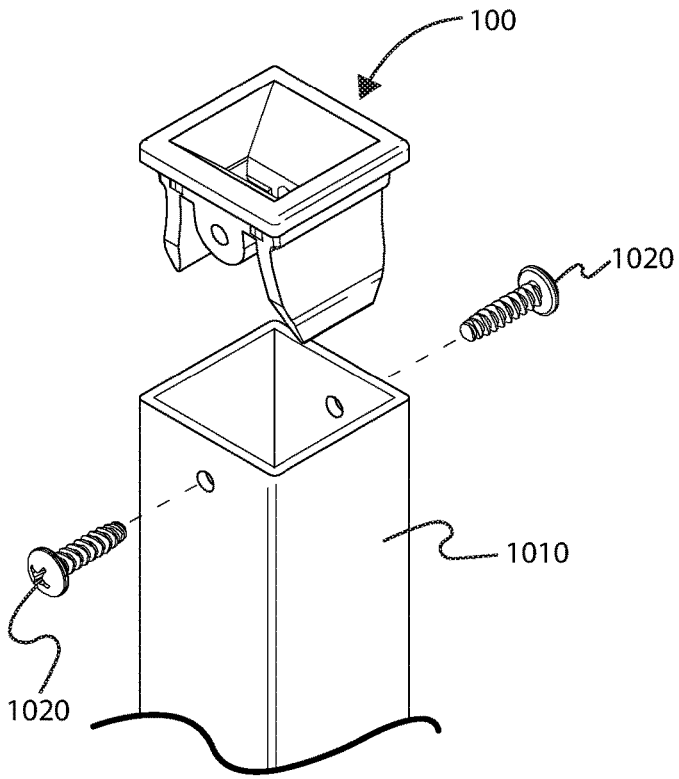
FIG. 10 is an exploded, perspective, environmental view of the example tool holder of FIG. 1.
Figure 11:
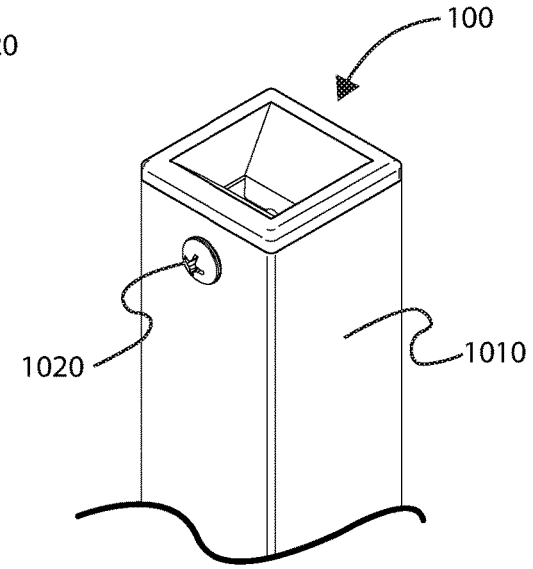
FIG. 11 illustrates an exploded, perspective, environmental view of the example tool holder of FIG. 1 operably inserted into a chamber.
Figure 12:
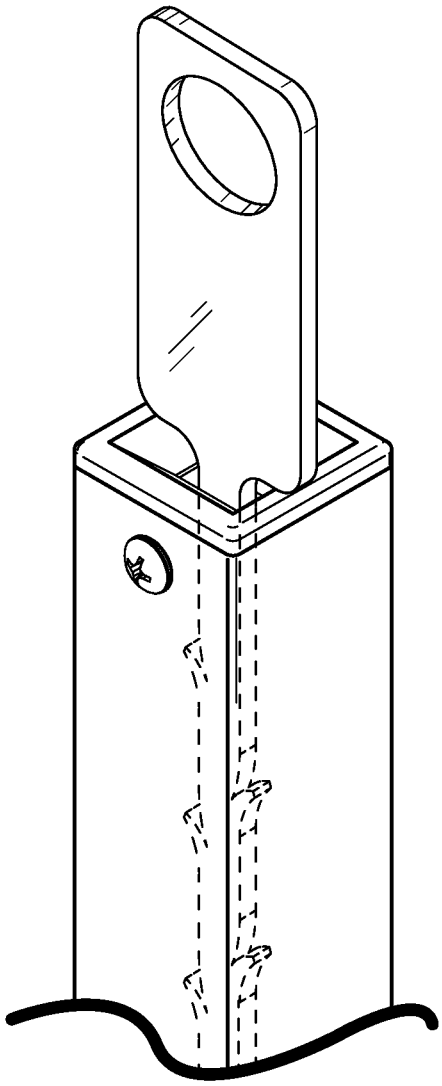
FIG. 12 illustrates an exploded, perspective, environmental view of the example tool holder of FIG. 1 operably inserted into a chamber and suspending a tool.

FIGS. 7-9 illustrate various views of the previously discussed elements of tool holder 100. FIGS. 10-12 are environmental perspective views of tool holder 100 and tube 1010 which defines a chamber. In FIG. 10-12, tool holder 100 is illustrated with respect to fasteners 1020 which cooperate with the fastener receiving structure 140 to secure the tool holder 100 in place with respect to tube 1010. FIG. 12 illustrates the tool holder 100 installed within tube 1010 and suspending elongated tool 1030.

It should further be appreciated that the aperture formed by the frame of the tool holder may be disposed completely within the collar of the holder, thereby being completely outside the chamber. Alternatively, the aperture formed by the frame of the tool holder may be disposed completely within the insertion element of the tool holder, thereby being disposed completely within the chamber. Finally, the aperture formed by the frame of the tool holder may be disposed partially within the collar and partially within insertion element of the tool holder, thereby being disposed partially inside and partially outside of the chamber.

Finally, to the extent that the term "includes" or "including" is employed in the detailed description or the claims, it is intended to be inclusive in a manner similar to the term "comprising," as that term is interpreted when employed as a transitional word in a claim. Furthermore, to the extent that the term "or" is employed in the claims (e.g., A or B) it is intended to mean "A or B or both." When the applicants intend to indicate "only A or B, but not both," then the term "only A or B but not both" will be employed. Similarly, when the applicants intend to indicate "one and only one" of A, B, or C, the applicants will employ the phrase "one and only one." Thus, use of the term "or" herein is the inclusive, and not the exclusive use. See Bryan A. Garner, A Dictionary of Modern Legal Usage 624 (2d. Ed. 1995).

What is claimed is:

1. A tool holder having an center axis, the tool holder comprising:

an insertion element, the insertion element comprising at least one retention element, each retention element configured to apply outward pressure in response to pressure applied toward the center axis of the tool holder;

a collar attached to and disposed at least partially above the insertion element, the collar defining an aperture generally perpendicular to the center axis of the tool holder; and a frame attached to the collar and the insertion element, the frame defining an aperture generally perpendicular to the center axis of the tool holder and aligned with the aperture formed by the collar, the frame further defining at least one rounded extraction wall, whereby when a barbed tool is inserted into the tool holder the at least one rounded extraction wall functions to prevent any barbs from catching on the tool holder when the tool is extracted.

2. The tool holder of claim 1 wherein the frame comprises at least one insertion wall, each insertion wall disposed such that the center axis of the tool holder in proximity to the collar and the insertion wall form an acute angle.

3. The tool holder of claim 1 further comprising a fastener receiving structure, the fastener receiving structure configured to receive a fastener.

4. The tool holder of claim 3 wherein the fastener receiving structure defines a fastener aperture.

5. The tool holder of claim 1 wherein each retention element exerts an outward force when pressure is applied toward the axial center of the tool holder.

6. The tool holder of claim 1 wherein the retention element is configured to mate with a recessed portion of a wall of a chamber when the tool holder is at least partially inserted within the chamber.

7. The tool holder of claim 1 wherein the retention element is configured to mate with a raised portion of a wall of a chamber when the tool holder is at least partially inserted within the chamber.

8. The tool holder of claim 1 wherein at least of portion of the aperture defined by the frame may be disposed within a void formed by a chamber.

9. The tool holder of claim 1 wherein at least of portion of the aperture defined by the frame may be disposed outside of a void formed by a chamber.

10. The tool holder of claim 1 comprising two retention elements.

11. The tool holder of claim 10 wherein the retention elements are fins.

12. The tool holder assembly of claim 1 wherein each retention element exerts an outward force when pressure is applied toward the axial center of the tool holder.

13. The tool holder assembly of claim 1 wherein the retention element is configured to mate with a recessed portion of a wall of a chamber when the tool holder is at least partially inserted within the chamber.

14. The tool holder assembly of claim 1 wherein the retention element is configured to mate with a raised portion of a wall of a chamber when the tool holder is at least partially inserted within the chamber.

15. The tool holder assembly of claim 1 wherein at least of portion of the aperture defined by the frame may be disposed within a void formed by a chamber.

16. The tool holder assembly of claim 1 wherein at least of portion of the aperture defined by the frame may be disposed outside of a void formed by a chamber.

17. A tool holder assembly, comprising:

a tube having a square opening at a first end; and a tool holder having an center axis, the tool holder comprising:

an insertion element comprising at least one retention element, each retention element configured to apply outward pressure in response to pressure applied toward the center axis of the tool holder;

a collar attached to and disposed at least partially above the insertion element, the collar sized defining an aperture generally perpendicular to the center axis of the tool holder; and a frame attached to the collar and the insertion element, the frame defining an aperture generally perpendicular to the center axis of the tool holder and aligned with the aperture formed by the collar, the frame further defining at least one rounded extraction wall, whereby when a barbed tool is inserted into the tool holder the at least one rounded extraction wall functions to prevent any barbs from catching on the tool holder when the tool is extracted.

18. The tool holder assembly of claim 17 wherein the frame comprises at least one insertion wall, each insertion wall disposed such that the center axis of the tool holder in proximity to the collar and the insertion wall form an acute angle.

19. The tool holder assembly of claim 17 further comprising a fastener receiving structure, the fastener receiving structure configured to receive a fastener.

20. The tool holder assembly of claim 19 wherein the fastener receiving structure defines a fastener aperture.

21. The tool holder assembly of claim 17 comprising two retention elements.

22. The tool holder assembly of claim 21 wherein the retention elements are fins.

* * * * *